US008793844B2

(12) United States Patent
McFalls et al.

(10) Patent No.: US 8,793,844 B2
(45) Date of Patent: Aug. 5, 2014

(54) LOCKING TONGUE FOR A SAFETY BELT

(75) Inventors: Bob L. McFalls, Shelby Township, MI (US); John J. Donnellon, Emmett, MI (US); Andrew F. Hartman, Capac, MI (US); Michael P. Gleason, Oakland, MI (US); Jeffery Rosso, Imlay City, MI (US); Hans-Peter Betz, Boebingen (DE); Peter Haas, Eschach (DE); Todd M. Sabalinski, Clinton Township, MI (US)

(73) Assignee: TRW Vehicle Safety Systems, Inc., Washington, MI (US)

( * ) Notice: Subject to any disclaimer, the term of this patent is extended or adjusted under 35 U.S.C. 154(b) by 50 days.

(21) Appl. No.: 13/236,757

(22) Filed: Sep. 20, 2011

(65) Prior Publication Data

US 2012/0068520 A1 Mar. 22, 2012

Related U.S. Application Data

(60) Provisional application No. 61/384,448, filed on Sep. 20, 2010.

(51) Int. Cl.
*A44B 11/25* (2006.01)

(52) U.S. Cl.
CPC ..... *A44B 11/2553* (2013.01)
USPC ..... 24/170; 24/182

(58) Field of Classification Search
USPC ..... 24/170, 171, 174, 178, 181, 182, 194, 24/196, 168
See application file for complete search history.

(56) References Cited

U.S. PATENT DOCUMENTS

| | | | | | |
|---|---|---|---|---|---|
| 4,551,889 | A * | 11/1985 | Narayan et al. | 24/196 |
| 5,100,176 | A * | 3/1992 | Ball et al. | 280/801.1 |
| 5,138,749 | A * | 8/1992 | McCune et al. | 24/196 |
| 5,222,278 | A * | 6/1993 | Ball et al. | 24/198 |
| 5,806,148 | A | 9/1998 | McFalls et al. | |
| 5,870,816 | A * | 2/1999 | McFalls et al. | 29/434 |
| 6,390,562 | B1 * | 5/2002 | Takamizu et al. | 297/483 |
| 7,010,836 | B2 * | 3/2006 | Acton et al. | 24/265 BC |
| 7,185,919 | B2 * | 3/2007 | Mather et al. | 280/808 |
| 7,325,280 | B2 * | 2/2008 | Ichida | 24/170 |
| 7,404,239 | B1 * | 7/2008 | Walton et al. | 24/193 |
| 7,712,194 | B2 * | 5/2010 | Fyhr | 24/171 |
| 2004/0158955 | A1 * | 8/2004 | Acton et al. | 24/265 BC |

* cited by examiner

*Primary Examiner* — Robert J Sandy
*Assistant Examiner* — David Upchurch
(74) *Attorney, Agent, or Firm* — Tarolli, Sundheim, Covell & Tummino LLP

(57) ABSTRACT

A locking tongue has a base part, a webbing slot in the base part and a locking cam. The locking cam is movable between a rest position and a clamping position. A biasing means biases the locking cam towards the rest position. The locking cam can assume the rest position in which the belt webbing can pass freely through the webbing slot, a clamping position in which the locking cam presses the belt webbing against the clamping edge of the webbing slot, the biasing means being able to return the locking cam from the clamping position into the rest position, and a locking position in which the locking cam locks the belt webbing in the webbing slot, the biasing means not being able to return the locking cam from the locking position towards the rest position.

19 Claims, 10 Drawing Sheets

LOCKING TONGUE FOR A SAFETY BELT

RELATED APPLICATION

This application corresponds to U.S. Provisional Application Ser. No. 61/384,448, filed Sep. 20, 2010, the subject matter of which is incorporated herein by reference.

TECHNICAL FIELD

The invention relates to a locking tongue for a seat belt system, having a base part, a webbing slot in the base part through which the belt webbing can extend, and a locking cam associated to the webbing slot and supported in the base part, the locking cam being movable between a rest position and a clamping position.

BACKGROUND OF THE INVENTION

A locking tongue after this type is known from U.S. Pat. No. 5,806,148. The locking cam of U.S. Pat. No. 5,806,148 is arranged such that the belt webbing can pass freely through the webbing slot when the locking cam assumes its rest position. When the seat belt is being used by a vehicle occupant, he or she inserts the locking tongue into a seat belt buckle associated with the respective seat. Under the assumption that the seat belt is part of a conventional three point safety belt system, the locking tongue divides the seat belt into a torso portion and a lap portion. In a case in which the seat belt restrains the vehicle occupant, the load acting in the belt webbing acts on the locking cam so as to pivot the locking cam towards the clamping position. In the clamping position, the locking cam prevents or at least significantly reduces any slipping of the belt webbing through the webbing slot. This reduces the forward movement of the pelvis region of the vehicle occupant.

SUMMARY OF THE INVENTION

The object of the invention is to improve the known locking tongue with respect to the handling of the locking tongue in a non-buckled condition. The present invention provides a locking tongue, in which a biasing means is provided which biases the locking cam towards the rest position. The biasing means ensures that the locking cam cannot unintentionally clamp the belt webbing in the webbing slot, for example when the vehicle occupant unfastens the seat belt.

According to one embodiment of the invention, the biasing means is a spring. This results in a very compact configuration.

Preferably, the biasing means is formed by a torsion spring. The torsion spring can be arranged in close proximity to the locking cam and imparts a rotational biasing force.

According to an alternative embodiment, the biasing means is an elastomeric spring. An elastomeric spring is advantageous as it can be mounted in a very simple manner.

Preferably, the elastomeric spring is formed with at least two distinct compression segments. This allows different clamping positions which are assumed by the locking cam depending on the particular level of load which acts in the belt webbing.

According to an embodiment of the invention, a shear pin is provided which can be sheared off by the locking cam. The shear pin defines a locking position of the locking cam which is not assumed during normal operation. If the force acting in the belt webbing is high enough for shearing off the shear pin, the locking cam moves into a locking position.

According to an embodiment, the locking cam is mounted pivotably on a pivot stud, the pivot stud being connected to the base part by means of a plastics overmould fixed to the base part. This embodiment allows integrating the mounting portions for pivotably supporting the locking cam into the plastics overmould which is typically provided on the base part.

According to an alternative embodiment, the locking cam is mounted pivotably on a pivot stud, the pivot stud being held in bearing portions formed integrally with the base part. In this embodiment, the clamping loads acting on the locking cam are directly transferred into the base part so that the plastics overmould must not be designed in view of the clamping forces.

The invention also provides a combination of a locking tongue as described above and a seat belt, the seat belt extending through the webbing slot, an edge of the webbing slot acting as a clamping edge against which the belt webbing can be pressed by the locking cam. The dimensions of the webbing slot, the locking cam and the belt webbing are adjusted such that the locking cam can assume at least three positions. The locking cam has a rest position in which the belt webbing can pass freely through the webbing slot. The locking cam has at least one clamping position in which the locking cam presses the belt webbing against the clamping edge of the webbing slot such that the belt webbing is tightly clamped. The biasing means is able to return the locking cam from the clamping position into the rest position. The locking cam has a locking position in which the locking cam locks the belt webbing in the webbing slot. The biasing means is not able to return the locking cam from the locking position towards the rest position. The locking position is assumed by the locking cam in case of very high loads acting on the belt webbing. Once such high loads have occurred, the components of the seat belt system should be replaced. The locking cam remaining in the locking position provides a clear indication to the vehicle occupant that a repair is now necessary as the locking tongue is now held stationary on the belt webbing, preventing a belt retractor from taking up the belt webbing of the unfastened seat belt.

A shear pin may define the clamping position. The shear pin ensures that the locking cam is held in the clamping position up to a certain level of load. If the loads acting in the belt webbing exceed a certain threshold, the shear pin will be sheared off or give way, and the locking cam can reach the locking position.

BRIEF DESCRIPTION OF THE DRAWINGS

The invention will now be described with reference to different embodiments which are shown in the drawings. In the drawings.

DESCRIPTION OF EXEMPLARY EMBODIMENTS

Figure 1:
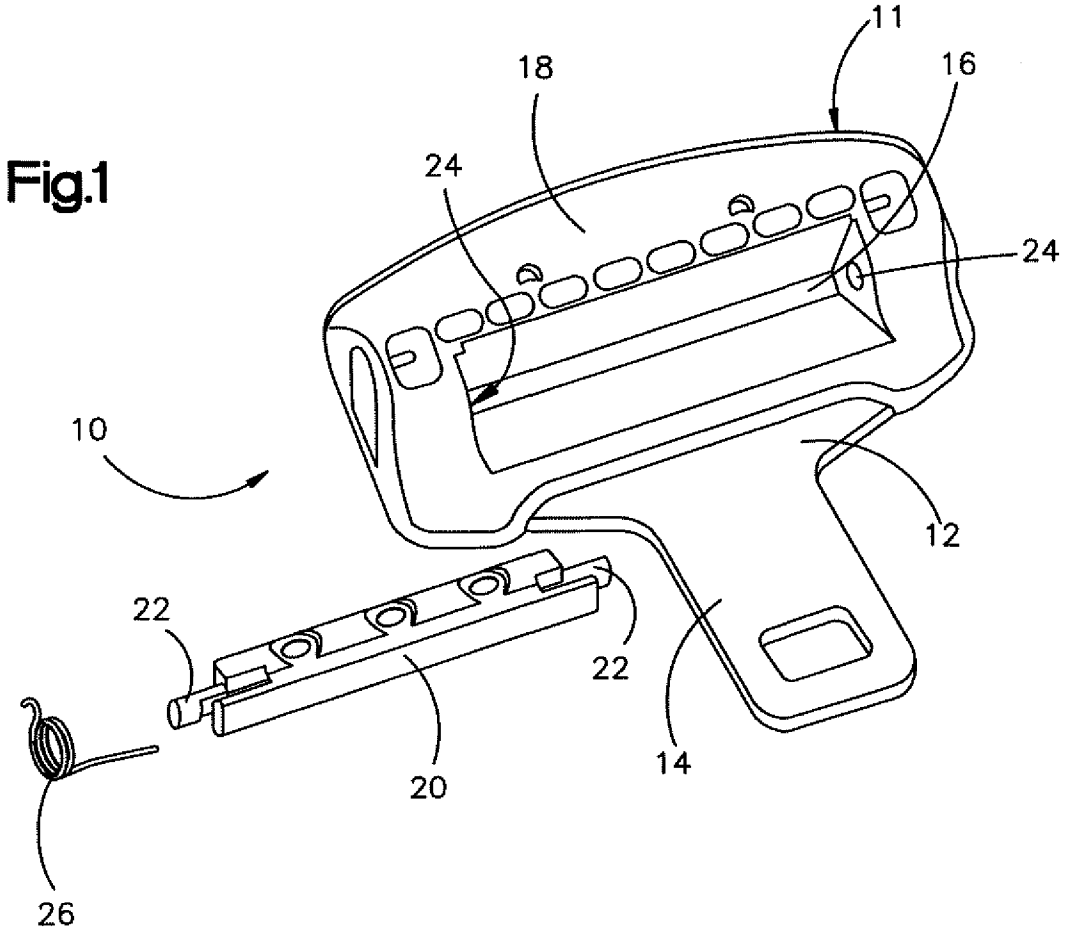
FIG. 1 shows a perspective, exploded view of a locking tongue according to a first embodiment.
Figure 2:
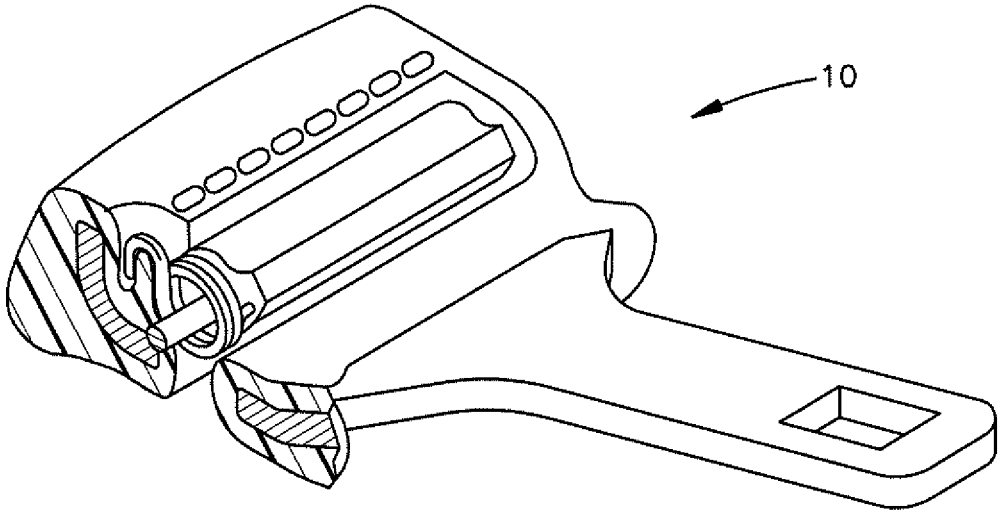
FIG. 2 shows a perspective, partially cut view of the locking tongue shown in FIG. 1.

In FIGS. 1 to 6, a locking tongue 10 according to a first embodiment is shown. Locking tongue 10 is part of a safety belt system for a vehicle and is intended for being inserted into a seat belt buckle (not shown).

Locking tongue 10 comprises a base 11 having a base part 12 typically made from metal, with base part 12 having an insert portion 14 which can be locked in the seat belt buckle. Base part 12 further comprises a webbing slot 16 through which the belt webbing 44 (please see FIG. 4) extends. Webbing slot 16 is formed as a cut-out in base part 12.

A cover 18 is provided on base part 12, the cover 18 being formed as a plastic part directly molded onto and partially over base part 12. As it can be seen in particular in FIGS. 2 and 3, cover 18 covers the edges of the cut-out provided in base part 12 for forming webbing slot 16. The slot defined by the surfaces of cover 18 is generally rectangular and extends through locking tongue 10 in a direction which extends at an angle $\alpha$ of approximately 45 degrees with respect to a plane in which locking portion 14 extends (please see FIG. 4).

Figure 3:
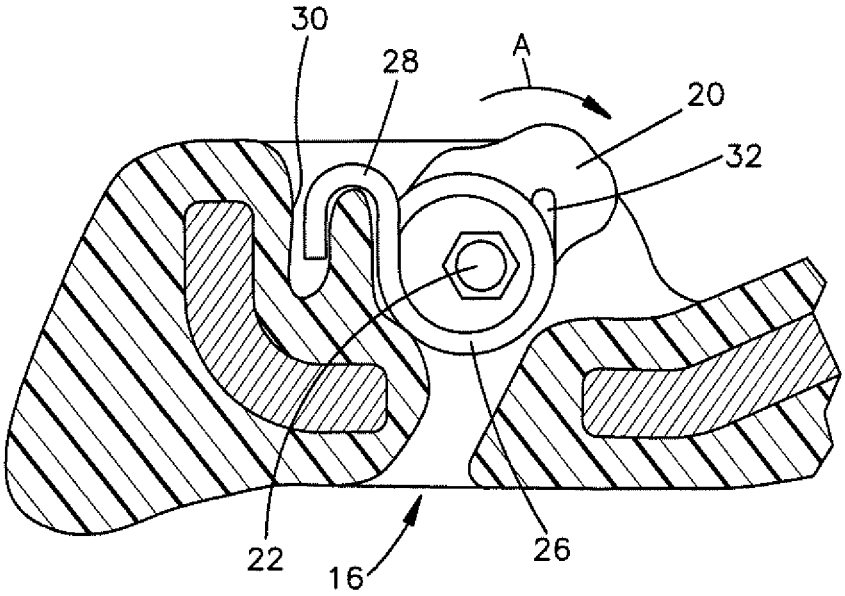
FIG. 3 shows at an enlarged scale a detail of FIG. 2.
Figure 6:
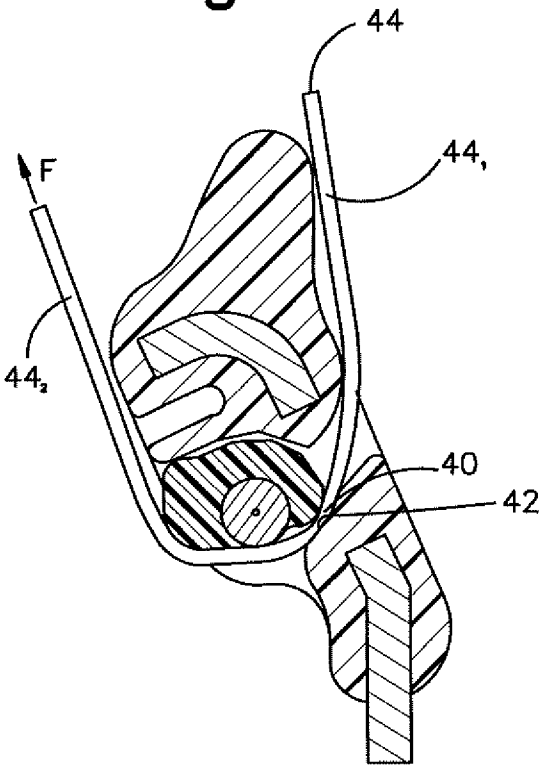
FIG. 6 shows the locking tongue of FIG. 4 with the locking cam in a clamping position.

A locking cam 20 is mounted pivotably on cover 18 of locking tongue 10, with the pivot axis of locking cam 20 being parallel to the longitudinal direction of webbing slot 16. Locking cam 20 is held by two pivot studs 22 which engage into bearing openings 24 formed in cover 18 close to the outer ends of webbing slot 16. A biasing means formed as a spring 26 is provided, which with one end leg 28 engages into a support opening 30 in cover 18 and with its other end leg 32 engages into locking cam 20. With reference to FIG. 3, spring 26 biases locking cam 20 in the direction of arrow A into the position shown in FIG. 3. It is contemplated that any desired spring may be used to bias the locking cam 20 in the direction of arrow A, such as a helical or leaf spring.

Figure 4:
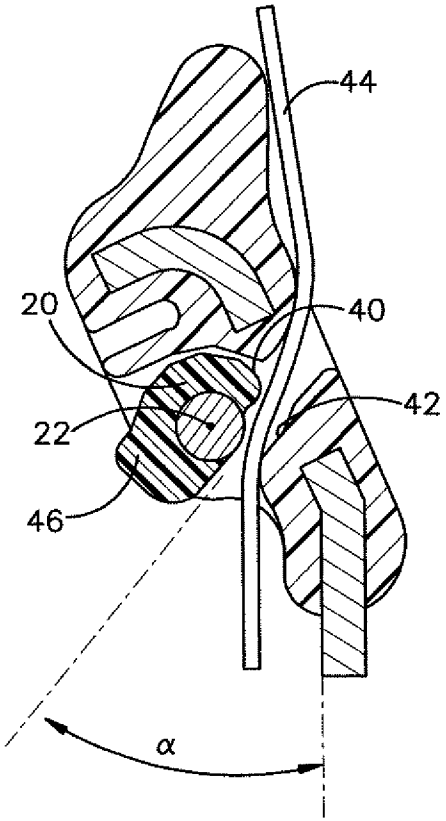
FIG. 4 shows the locking tongue according to the first embodiment with the locking cam in a rest position.
Figure 8:
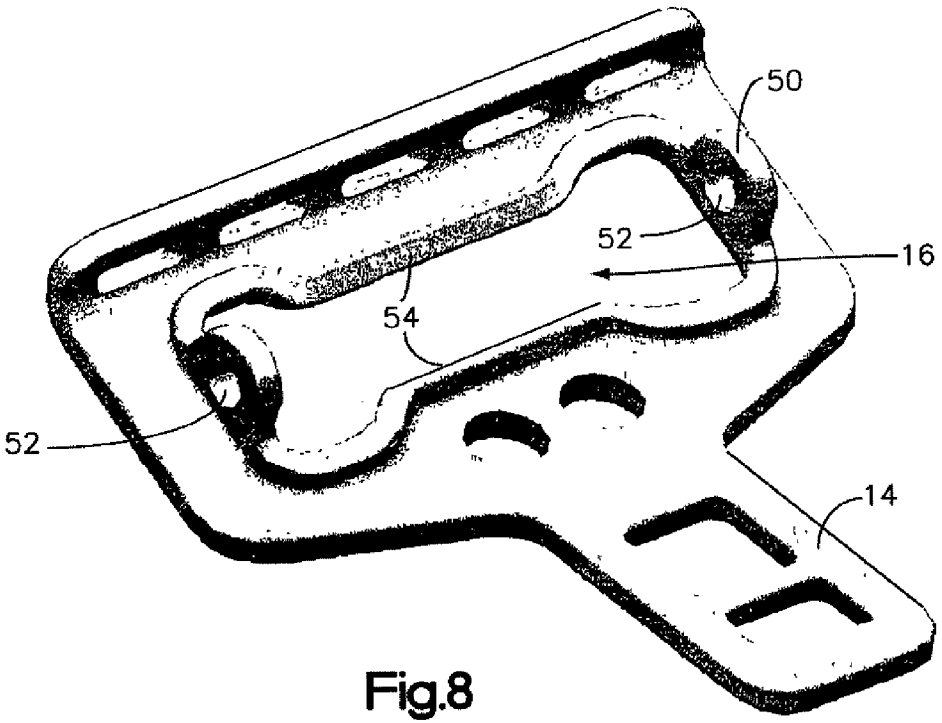
FIG. 8 shows the base part of FIG. 7 in a second perspective view.
Figure 7:
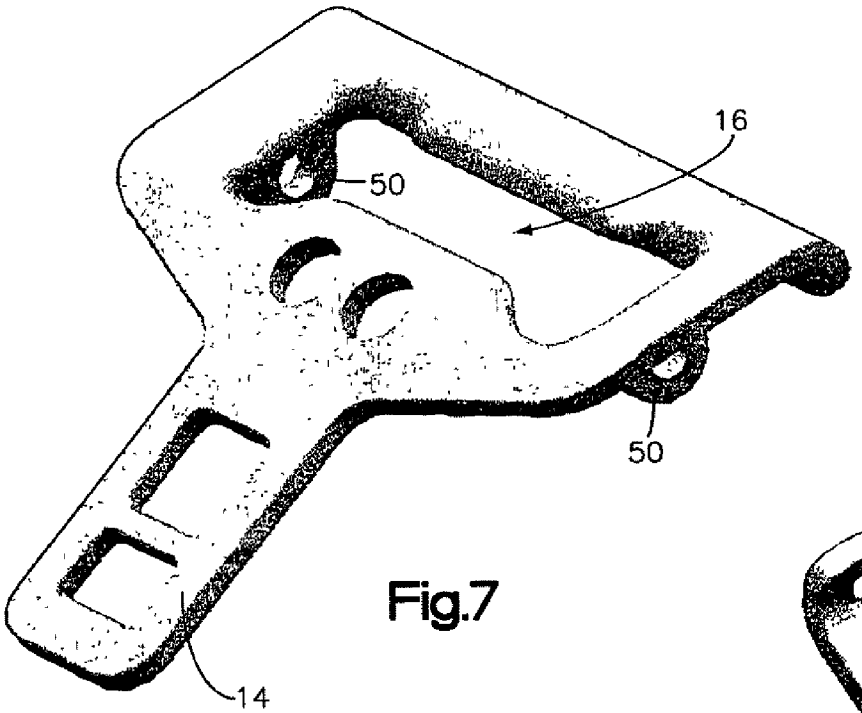
FIG. 7 shows in a first perspective view of a base part for a locking tongue according to a second embodiment.
Figure 9:
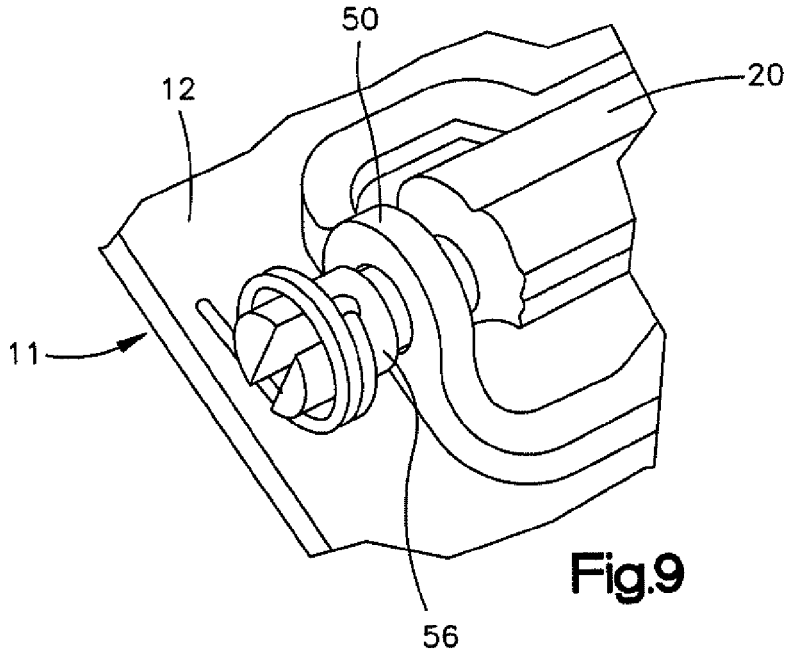
FIG. 9 shows a detail of the second embodiment.
Figure 10:
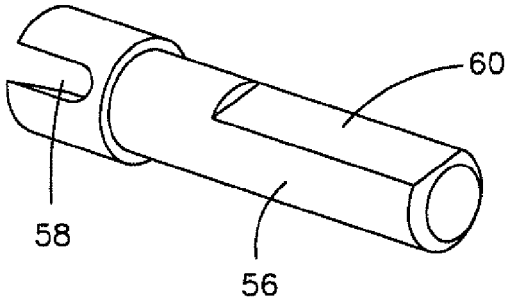
FIG. 10 shows a bearing pin used with the second embodiment.
Figure 11:
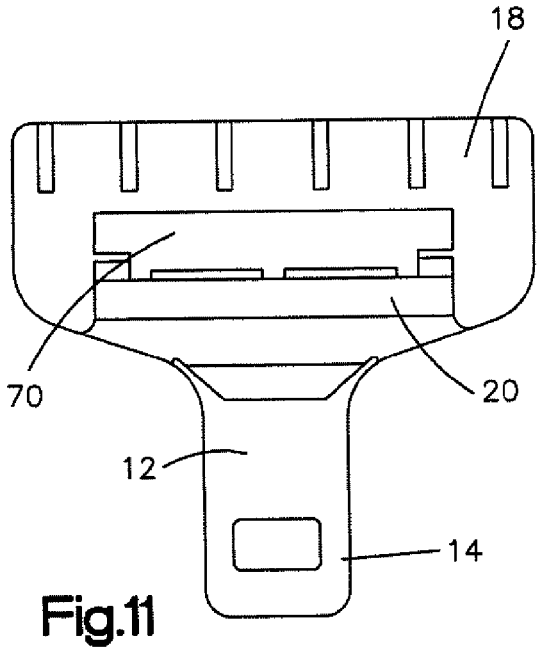
FIG. 11 shows a side view of a locking tongue according to a third embodiment.

As can be seen in greater detail in FIG. 4, locking cam 20 is provided with a locking portion 40 which, in the rest position shown in FIG. 4, is arranged at one side of webbing slot 16 spaced from a clamping edge 42 formed opposite locking portion 40 on cover 18. With locking cam 20 in the rest position, the belt webbing can pass freely through webbing slot 16 so that locking tongue 10 can be displaced along the belt webbing 44.

Locking cam 20 further is provided with a pressing portion 46 which is arranged approximately opposite locking portion 40 when taking the pivot axis defined by the centre line of pivot studs 22 of locking cam 20 as a reference. The maximum distance of pressing portion 46 from the pivot axis of locking cam 20 is larger than the maximum distance of locking portion 40 therefrom.

When the seat belt is fastened and the locking tongue 10 is engaged into a seat belt buckle, belt webbing 44 extends in a U-shape along cover 18 through webbing slot 16 and back along the cover. The locking tongue then divides the seat belt into two portions, namely a first portion $\mathbf{44}_1$ and a second portion $\mathbf{44}_2$, with the first portion typically being a torso portion and the second portion typically being a lap portion.

Figure 5:
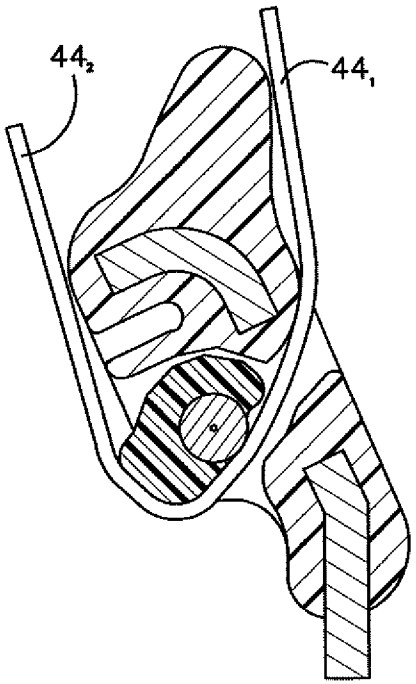
FIG. 5 shows the locking tongue of FIG. 4 with a locking cam in an intermediate position.

When the belt webbing extends around locking cam 20, it contacts pressing portion 46 (please see FIG. 5). If a high load is exerted on the belt webbing in this condition, in particular on portion $\mathbf{44}_2$ of the seat belt in the direction of arrow F in FIG. 6, the frictional engagement between the belt webbing and pressing portion 46 in combination with the lever arm of pressing portion 46 results in locking cam 20 being pivoted against the action of spring 26 into the clamping position shown in FIG. 6. In the clamping position, clamping portion 40 clamps belt webbing 44 against clamping edge 42 of webbing slot 16 such that the belt webbing is either completely or at least largely prevented from slipping through webbing slot 16. It is contemplated that the locking cam 20 may permit a desired amount of slippage of the webbing relative to the locking tongue 10 when the locking cam is in the clamping position. This reduces a forward displacement of the pelvis region of the vehicle occupant using the seat belt, or improves the restraining effect provided for a child seat.

When the locking tongue is disengaged from the belt buckle such that the belt retractor can roll up the belt webbing, spring 26 returns locking cam 20 into the rest position shown in FIGS. 3 and 4 such that locking tongue 10 can freely slide on the belt webbing without there being a risk of an unintentional engagement of locking cam 20.

In FIGS. 7 to 10, the base part 12 of the base 11 for a locking tongue according to a second embodiment is shown. The difference between the first and the second embodiment is that in the second embodiment, base part 12 is provided with bearing portions 50 which are formed integrally with base part 12. In particular, bearing portions 50 are formed as stamped lugs at the edge of the cut-out forming webbing slot 16, and are bent by approximately 90° upwardly. Each bearing portion 50 comprises a bearing opening 24 which accommodates the bearing studs of locking cam 20.

In order to increase the stiffness of the locking tongue, flanges 54 are formed on the opposing longer edges of the cut-out forming webbing slot 16. This in particular increases the stiffness in the region against which the belt webbing is pressed when locking cam 20 is in the clamping position.

For pivotably supporting locking cam 20 in bearing portions 50, short studs 56 are used which each feature a slot 58 at the end where spring 26 is arranged. The end of stud 56 which engages into locking cam 20 is provided with a flattened portion 60, which allows to transmit the torque from the spring towards the locking cam and which further guarantees that slot 58 is maintained in the same orientation on both sides of the locking cam, so that the end leg of the spring engaging into slot 58 are maintained in the same angular position.

A third embodiment of locking tongue 10 is shown in FIGS. 11 to 15. The difference between the third embodiment and the previous embodiments is that in the third embodiment, an elastomeric spring 70 is used as biasing means for urging locking cam 20 into the rest position shown in FIG. 12.

Spring 70 is here formed from three segments 72, 74 and 76 which are arranged in a row between a concave support portion 78 formed on cover 18 and a likewise concave abutment portion 80 formed on pressing portion 46 of locking cam 20. The biasing force provided by spring segment 76 is lower than the biasing force provided by spring segment 74, with the segment 76 being the one which abuts on locking cam 20. The spring segment 72 engages the concave support portion 78 on the cover 18.

Figure 12:
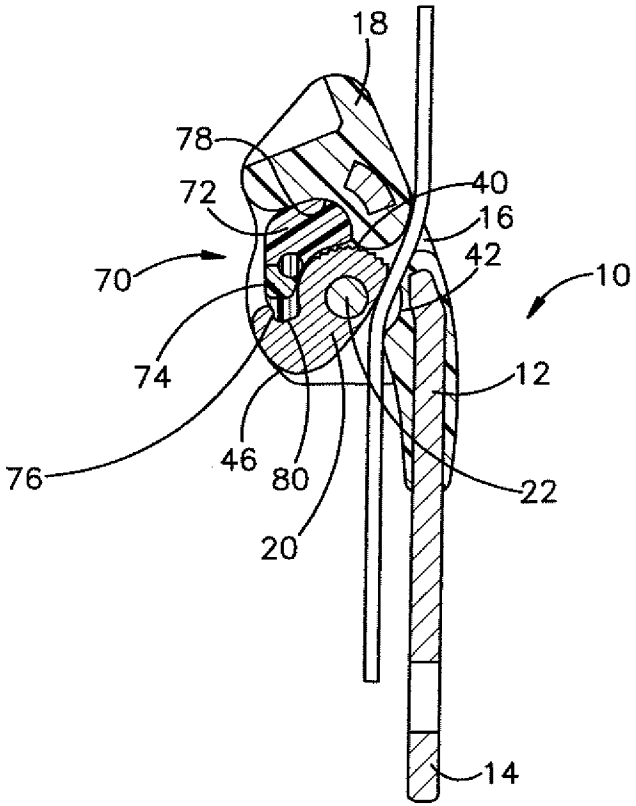
FIG. 12 shows a cross section of the locking tongue according to the third embodiment, with the locking cam being in the rest position.

Furthermore, a shear pin 82 is provided such that it can cooperate with abutment portion 80 of locking cam 20. As can be seen in FIG. 12, shear pin 82 is arranged between the first and the second segments 72, 74 of spring 70. Spring 70 holds locking cam 20 in the rest position shown in FIG. 12 such that the belt webbing can pass freely through webbing slot 16.

Figure 13:
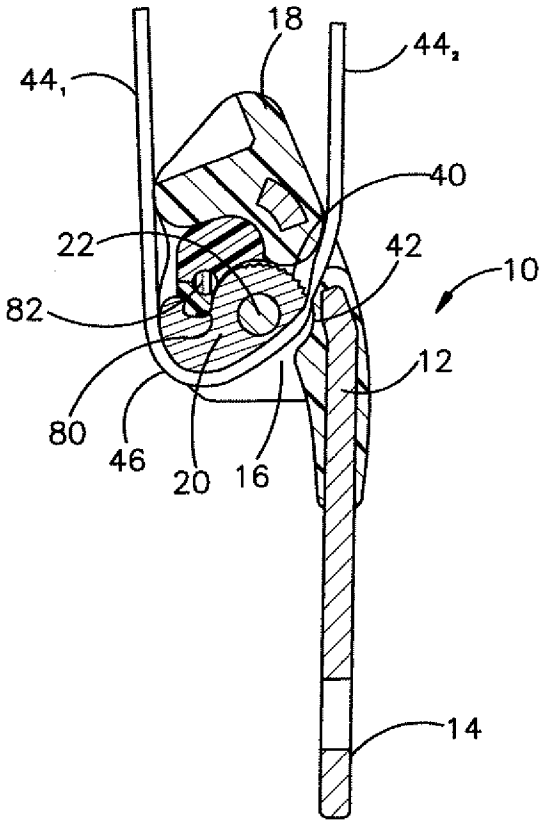
FIG. 13 shows the locking tongue of FIG. 12 with the locking cam in a first clamping position.

When the seat belt is fastened such that the belt webbing runs in a U-shape through webbing slot 16 and around locking cam 20, a certain level of load acting in the seat belt portion $\mathbf{44}_1$ results in locking cam 20 being pivoted into a first clamping position which is shown in FIG. 13. When locking cam 20 is being pivoted into the first clamping position, the third segment 76 of spring 70 is compressed. In the first clamping position, clamping portion 40 of locking cam 20 presses the belt webbing against clamping edge 42 of cover 18 such that any slipping of the belt webbing through webbing slot 16 is prevented up to a certain level.

Figure 14:
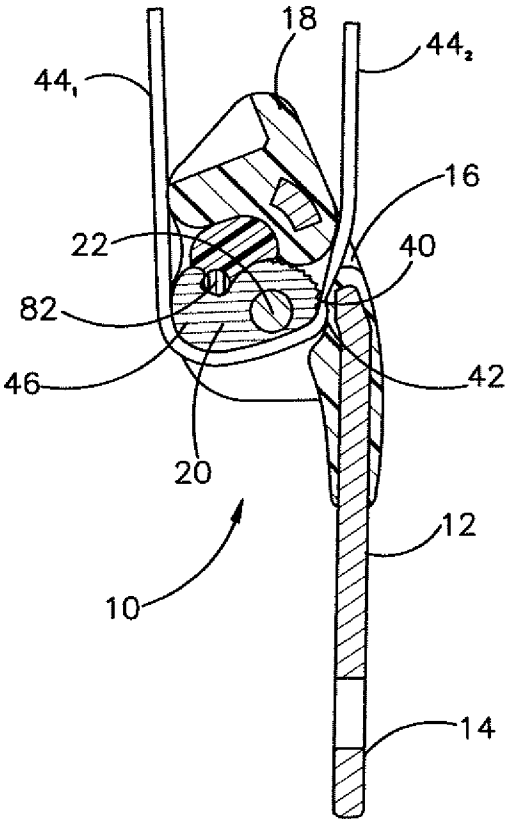
FIG. 14 shows the locking tongue of FIG. 12 with the locking cam in a second clamping position.
Figure 16:
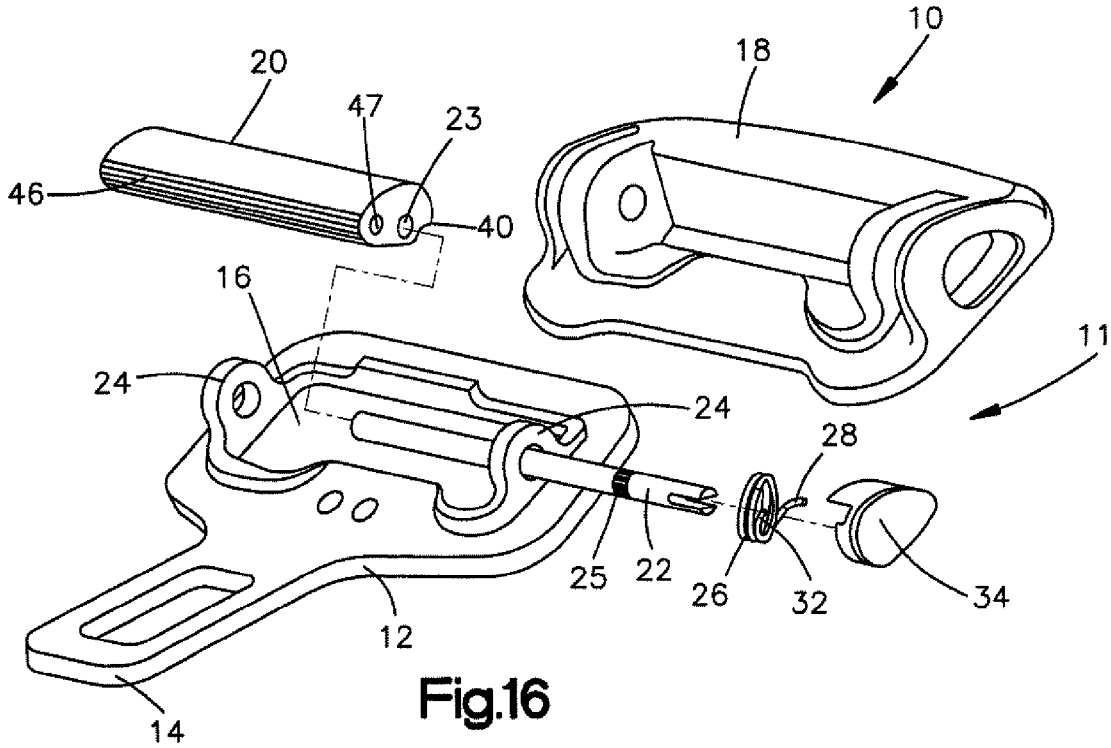
FIG. 16 shows a perspective, exploded view of a locking tongue according to a fourth embodiment.

When the loads acting on the belt webbing reach a higher level, locking cam 20 is rotated beyond the first clamping position into the second clamping position shown in FIG. 14. In the second clamping position, the second segment 74 of spring 70 is compressed, resulting in concave portion 80 of locking cam 20 abutting shear pin 82. In the second clamping position, the belt webbing is clamped with higher clamping forces as compared to the first clamping position, resulting in higher forces being necessary for pulling the belt webbing through webbing slot 16.

In both the first and the second clamping positions shown in FIGS. 13 and 14, spring 70 is capable of returning locking cam 20 into the rest position when the seat belt is unfastened and the portion $\mathbf{44}_1$ of the seat belt ceases to act on pressing portion 46 of locking cam 20.

Figure 15:
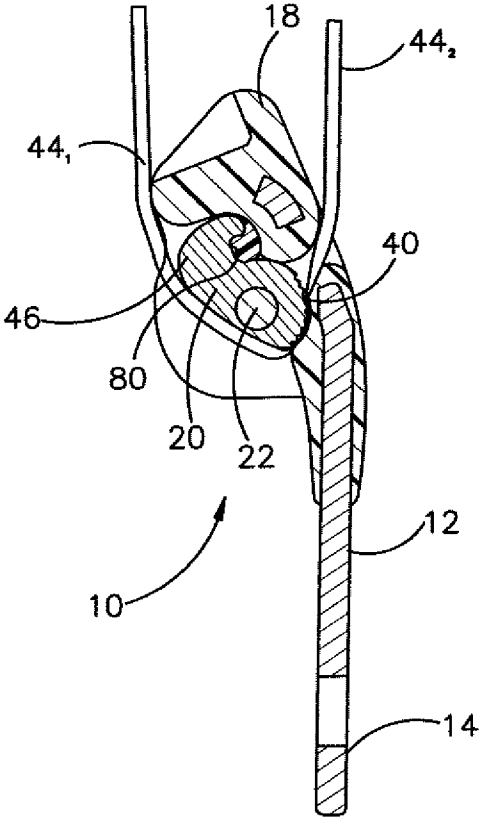
FIG. 15 shows the locking tongue of FIG. 12 with the locking cam in a locking position.

When even higher forces act in the seat belt than in a condition which makes locking cam 20 assume the second clamping position, shear pin 82 is sheared off, and locking cam 20 is brought into a third locking position which is shown in FIG. 15. In the third locking position, spring 70 is almost completely compressed, and locking portion 40 tightly locks the belt webbing against clamping edge 42 of locking tongue 10. If the locking position shown in FIG. 15 is reached, spring 70 is not capable of returning locking cam 20 towards the rest position, resulting in the belt webbing being locked in this particular position at locking tongue 10. This is a clear indication for a vehicle occupant that the components of the seat belt system require replacement.

A locking tongue 10 according to a fourth embodiment is shown in FIGS. 16-19. The locking tongue 10 includes a base 11 having a base part 12 with an insert portion 14 that engages a seat belt buckle. The base part 12 includes a webbing slot 16 through which the belt webbing extends.

A cover 18 is directly molded onto and partially over base part 12. The cover 18 covers the edges of the slot 16 in base part 12. A locking cam 20 is mounted pivotably on cover 18 of locking tongue 10 by a pivot shaft 22. The locking cam 20 may be made of one-piece or a plurality of pieces connected together. The locking cam 20 may be formed of aluminum, steel, plastic, magnesium or any other desired material or combinations of material. The pivot shaft 22 extends through an opening 23 in the locking cam 20. A pivot axis of the locking cam 20 and the pivot shaft 22 extends parallel to the longitudinal direction of webbing slot 16.

The pivot shaft 22 extends into openings in flanges 24 of the base part 12. The flanges 24 extend from opposite sides of the webbing slot 16. Opposite ends of the pivot shaft 22 extend into openings in the cover to help retain the pivot shaft in the flanges 24. The flanges 24 support the pivot shaft 22 and the locking cam 20 for pivotal movement relative to the base part 12 and the cover 18.

The pivot shaft 22 includes a knurled surface 25 that prevents relative rotation between the pivot shaft 22 and the locking cam 20 and helps transfer torque between the locking cam 20 and the pivot shaft 22. The locking cam 20 may include a knurled surface that engages the knurled surface 25 on the pivot shaft 22. It is contemplated that the pivot shaft 22 and the locking cam 20 may be connected to each other in any desired manner. The pivot shaft 22 and the locking cam 20 may have mating splines or flat surfaces. It is also contemplated that the pivot shaft 22 may be press fit into the locking cam 20 or formed as one piece with the locking cam.

Figure 17:
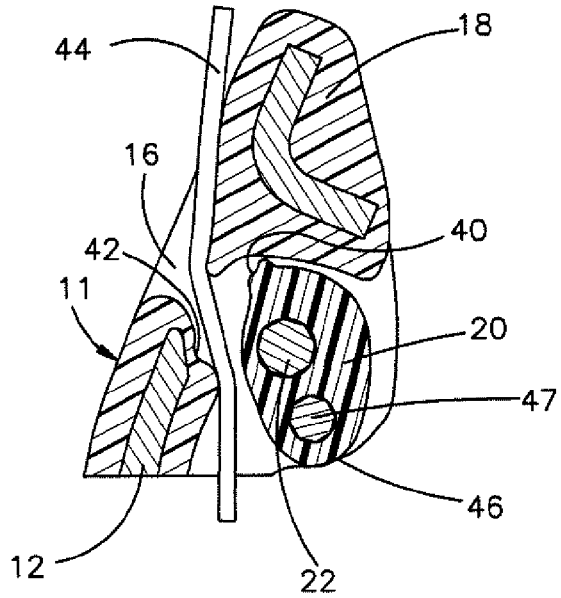
FIG. 17 shows a cross-sectional view of a portion of the locking tongue of FIG. 16 showing a locking cam in a rest position.
Figure 18:
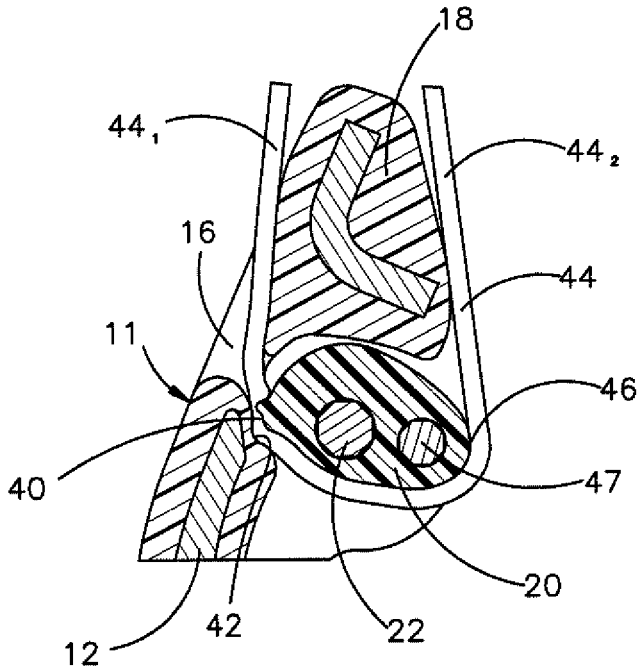
FIG. 18 shows a cross-sectional view of a portion of the locking tongue of FIG. 16 showing the locking cam in a clamping position.
Figure 19:
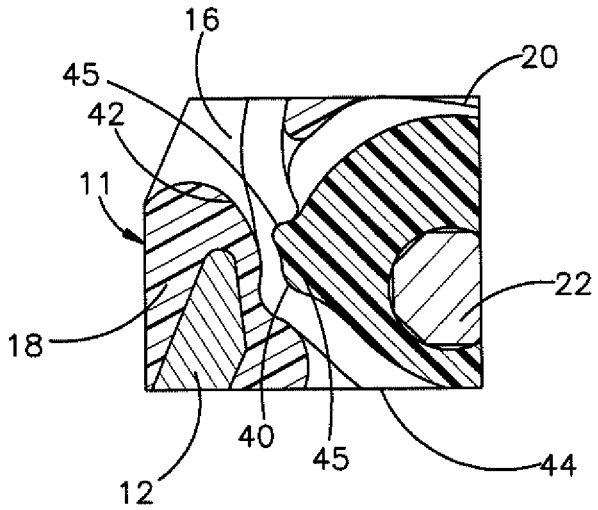
FIG. 19 shows an enlarged view of a portion of the locking cam of FIG. 18.

A biasing means, such as a spring 26 urges the locking cam into a rest position, shown in FIG. 17. The spring 26 has a first leg 28 that engages the cover 18. A second leg 32 of the spring 26 extends into a slot in an end of the pivot shaft 22. The legs of the pivot shaft 22 defining the slot may be bent to connect the second leg 32 to the pivot shaft. Accordingly, the second leg 32 of the spring 26 pivots with the pivot shaft 22 and the locking cam 20 relative to the base part 12 and the cover 18. It is contemplated that any desired spring may be used to bias the locking cam 20 toward the rest position and the spring may be connected to the locking cam 20 and/or the pivot shaft in any desired manner. A cap 34 may snap into the cover 18 to help protect the spring 26.

Figure 20:
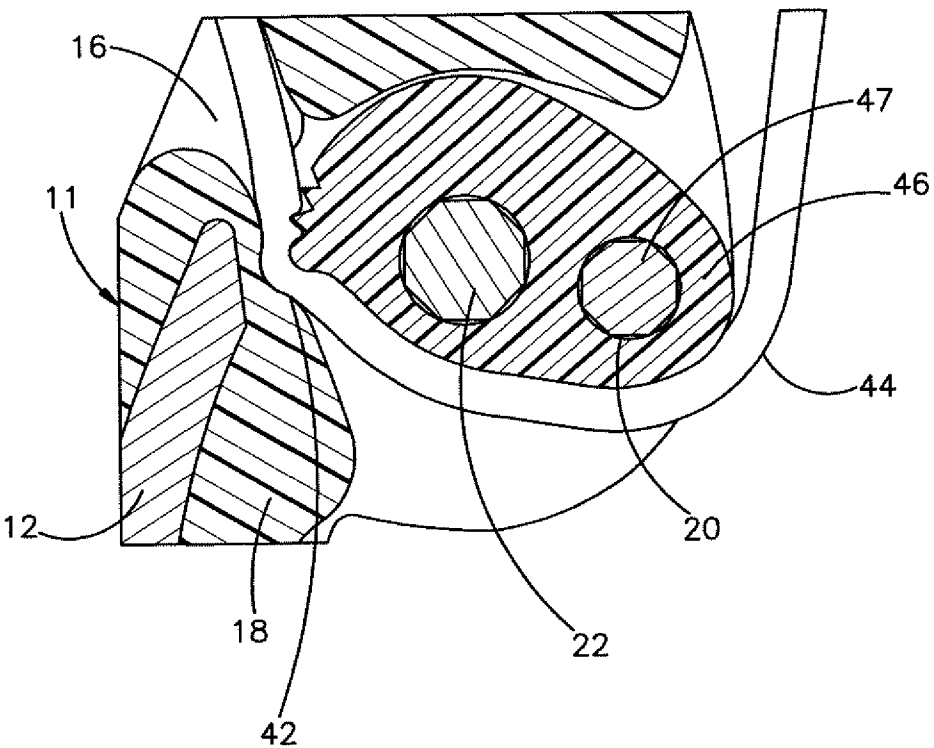
FIG. 20 shows an enlarged view of a portion of an another embodiment of a locking cam.

The locking cam 20 is provided with a locking portion 40 which, in the rest position shown in FIG. 17, is spaced from a clamping edge 42 formed on cover 18. With locking cam 20 in the rest position, the belt webbing can pass freely through webbing slot 16 so that locking tongue 10 can be displaced along the belt webbing 44. The locking portion 40 clamps the belt webbing 44 to the clamping edge 42 on the cover 18 when the locking cam is in the clamping position shown in FIGS. 18 and 19. The locking portion 40 may include ribs or teeth 45 that extend along the length of the locking cam 20. Although the locking portion 40 is shown as having two ribs 45, it is contemplated that the locking portion may have any desired number of ribs, including only one rib. It is also contemplated that the locking portion 40 may have a plurality of teeth, as shown in FIG. 20.

The ribs 45 or teeth may not extend the entire length of the locking cam 20. Also, the clamping edge 42 on the cover 18 may not extend the entire length of the slot. If the teeth or ribs 45 and/or the clamping edge 42 do not extend the entire length of the slot, the webbing 44 will not be clamped near the edges of the webbing when the locking cam 20 is in the clamping position.

The locking cam 20 includes a pressing portion 46. The pressing portion 46 is on an opposite side of the pivot axis from the locking portion 40. The pressing portion 46 extends from the pivot axis of locking cam 20 a greater distance than the locking portion. An opening 47 may extend through the pressing portion 46 to help reduce the weight of the locking cam 20. It is contemplated that each end of the pressing portion 46 may have an opening extending into the pressing portion instead of a single opening extending through the pressing portion.

When the seat belt is fastened and the locking tongue 10 is engaged into a seat belt buckle, belt webbing 44 extends in a U-shape along cover 18 through webbing slot 16 and back along the cover. The locking tongue then divides the seat belt into two portions, namely a first portion $\mathbf{44}_1$ and a second portion $\mathbf{44}_2$, with the first portion typically being a torso portion and the second portion typically being a lap portion.

When the belt webbing extends around locking cam 20, it contacts pressing portion 46. If a high load is exerted on the belt webbing in this condition, in particular on portion $\mathbf{44}_2$ of the seat belt, the frictional engagement between the belt webbing and pressing portion 46 in combination with the lever arm of pressing portion 46 results in locking cam 20 being pivoted against the action of spring 26 into the clamping position shown in FIGS. 18 and 19. In the clamping position, clamping portion 40 clamps belt webbing 44 against clamping edge 42 of the cover 18 such that the belt webbing is either completely or at least largely prevented from slipping through webbing slot 16. This prevents a forward displacement of the pelvis region of the vehicle occupant using the seat belt, or improves the restraining effect provided for a child seat.

When the locking tongue is disengaged from the belt buckle such that the belt retractor can roll up the belt webbing, spring 26 returns locking cam 20 into the rest position shown in FIG. 17 such that locking tongue 10 can freely slide on the belt webbing without there being a risk of locking cam 20 moving into the clamping position.

Having described the invention, the following is claimed:

1. A locking tongue (10) for a seat belt system comprising:

a base (11), the base having a locking portion (14) extending in a plane, a webbing slot (16) in the base extending transverse to the plane, the webbing slot extending in a direction transverse to an insertion direction of the locking tongue, the locking portion extending in the insertion direction from the webbing slot, the webbing slot configured to guide a belt webbing from a first side of the base to a second opposite side of the base when the belt webbing extends through the webbing slot and transverse to the plane; and a locking cam (20) associated to the webbing slot (16) and supported at the base, the locking cam (20) being movable between a rest position and a clamping position, wherein a biasing means (26; 70) is provided which biases the locking cam (20) towards the rest position, the entire locking cam only pivoting relative to the base about a single pivot axis.

2. The locking tongue of claim 1, wherein the biasing means is a metal spring (26).

3. The locking tongue of claim 2, wherein the biasing means is a torsion spring (26).

4. The locking tongue of claim 1, wherein the biasing means is an elastomeric spring (70).

5. The locking tongue of claim 4, wherein the elastomeric spring (70) is formed with at least two distinct compression segments (72,74,76).

6. The locking tongue of claim 1, wherein a shear pin (82) is provided which is sheared off by the locking cam (20).

7. The locking tongue of claim 1, wherein the locking cam (20) is mounted pivotably on a pivot stud (22), the pivot stud (22) being connected to the base part by means of a plastics overmould fixed to the base part.

8. The locking tongue of claim 1, wherein the locking cam (20) is mounted pivotably on a pivot stud (22), the pivot stud (22) being held in bearing portions (50) formed integrally with the base.

9. A combination of a locking tongue according to claim 1 and a seat belt comprising:

the belt webbing (44) extending through the webbing slot (16), an edge of the webbing slot (16) acting as a clamping edge (42) against which the belt webbing is pressed by the locking cam (20), the dimensions of the webbing slot (16), the locking cam (20) and the belt webbing (44) being adjusted such that the locking cam (20) assumes at least three positions, namely the rest position in which the belt webbing (44) passes freely through the webbing slot (16), a clamping position in which the locking cam (20) presses the belt webbing (44) against the clamping edge (42) of the webbing slot (16) such that the belt webbing (44) is tightly clamped, the biasing means (26; 70) returning the locking cam (20) from the clamping position into the rest position, and a locking position in which the locking cam (20) locks the belt webbing (44) in the webbing slot (16), the biasing means (26; 70) not returning the locking cam (20) from the locking position towards the rest position.

10. The combination of claim 9, wherein a shear pin (82) is provided which defines the clamping position.

11. The locking tongue of claim 1, wherein the locking cam only pivots relative to the base when the locking cam moves between the rest position and the clamping position.

12. The locking tongue of claim 11, wherein the belt webbing engages the locking cam when the belt webbing extends through the webbing slot and the locking cam is in the rest position.

13. A locking tongue for a seat belt system comprising:

a base having a webbing slot through which a belt webbing extends,-the belt webbing extending from a first side of the base, through the webbing slot, and to a second opposite side of the base;

a locking cam pivotally supported on the base, the locking cam having a rest position in which the belt webbing passes freely through the webbing slot and a clamping position in which the locking cam clamps the belt webbing to the base, the locking cam only pivoting relative to the base between the rest position and the clamping position, the entire locking cam only pivoting relative to the base about a single pivot axis, the locking cam contacting the belt webbing when in the rest position; and a biasing means which biases the locking cam towards the rest position.

14. The locking tongue of claim 13, wherein the biasing means includes an elastomeric spring formed with first and second compression segments, the first compression segment providing a different biasing force to the locking cam than the second compression segment.

15. The locking tongue of claim 14, wherein the first compression segment engages the locking cam and the second compression segment is spaced from the locking cam.

16. The locking tongue of claim 15, wherein the biasing force provided by the first compression segment is lower than the compression force provided by the second compression segment.

17. The locking tongue of claim 14, wherein a shear pin is sheared off by the locking cam.

18. The locking tongue of claim 13, wherein an edge of the webbing slot acts as a clamping edge against which the belt webbing is pressed by the locking cam, the biasing means pivoting the locking cam from the clamping position into the rest position, the locking cam having a locking position in which the locking cam locks the belt webbing in the webbing slot, the biasing means not being able to return the locking cam from the locking position towards the rest position.

19. The locking tongue of claim 1, wherein the first side of the base defines the plane, the second opposite side of the base extending generally parallel to the first side, the webbing slot extending through the base from the first side to the second opposite side.

* * * * *